US010930999B2

(12) United States Patent
Shen

(10) Patent No.: US 10,930,999 B2
(45) Date of Patent: Feb. 23, 2021

(54) ANTENNA MODULE AND MOBILE TERMINAL

(71) Applicant: AAC Technologies Pte. Ltd., Singapore (SG)

(72) Inventor: Yachuan Shen, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/702,501

(22) Filed: Dec. 3, 2019

(65) Prior Publication Data

US 2020/0212540 A1 Jul. 2, 2020

(30) Foreign Application Priority Data

Dec. 27, 2018 (CN) ..... 201822223712.6

(51) Int. Cl.
*H01Q 1/24* (2006.01)
*H01Q 5/328* (2015.01)
*H01Q 1/38* (2006.01)

(52) U.S. Cl.
CPC ..... *H01Q 1/243* (2013.01); *H01Q 1/38* (2013.01); *H01Q 5/328* (2015.01)

(58) Field of Classification Search
CPC ..... H01Q 1/243
See application file for complete search history.

(56) References Cited

U.S. PATENT DOCUMENTS 8,633,859 B2 * 1/2014 Chou ..... H01Q 5/378 343/700 MS
2005/0057404 A1 * 3/2005 Demicco ..... H01Q 1/088 343/702
2010/0304792 A1 * 12/2010 Li ..... H04B 1/3877 455/566
2015/0042533 A1 * 2/2015 Cheng ..... H01Q 1/36 343/817
2015/0263416 A1 * 9/2015 Okano ..... H01Q 5/371 343/702
2018/0115054 A1 * 4/2018 Wu ..... H01Q 5/35
2018/0375196 A1 * 12/2018 Han ..... H01Q 5/328

FOREIGN PATENT DOCUMENTS

CN 209329141 B1 8/2019

OTHER PUBLICATIONS

PCT search report dated Jan. 8, 2020 by SIPO in related PCT Patent Application No. PCT/CN2019/113303 (4 Pages).

* cited by examiner

*Primary Examiner* — Hsinchun Liao
(74) *Attorney, Agent, or Firm* — W&G Law Group LLP

(57) ABSTRACT

The present invention provides an antenna module and a mobile terminal. The mobile terminal comprises a back cover, a main board, a plastic back shell, and a USB interface, the antenna module comprises a radiator structured on a surface of the plastic back shell facing the back cover and a feeding point and a grounding point disposed on the main board, the antenna module further comprises a matching network, a first tuning switch, a second tuning switch and a third tuning switch, the surface of the plastic back shell facing the back cover includes a first structuring region for structuring the radiator and a second region other than the first structuring region, the radiator completely covers the first structuring region, and the orthographic projections of the radiator and the USB interface on the main board do not overlap each other.

9 Claims, 6 Drawing Sheets

ANTENNA MODULE AND MOBILE TERMINAL

TECHNICAL FIELD

The present disclosure relates to a field of communication technology, and in particular to an antenna module and a mobile terminal.

BACKGROUND

With the development of mobile communication technology, mobile phones, PADs, and notebook computers have gradually become indispensable electronic products in life, and such electronic products have been additionally provided with antenna modules so that they become electronic communication products with a communication function.

As the design of the mobile terminal becomes more and more thin, the arrangement for the antenna module and components inside the mobile terminal is inevitably compact due to a limitation of the size of the mobile terminal, and usually, a radiator of the antenna module is disposed across a USB interface, thus causing the USB interface interfere with the antenna. Moreover, in order to meet the requirement of Multiple-Input Multiple-Output (MIMO), the mobile terminal has more and more antennas built therein, further increasing the difficulty for arranging the antenna modules and the components inside the mobile terminal.

Laser Direct Structuring (LDS) refers to controlling movement of a laser according to a trajectory of a conductive graph by a computer, projecting the laser onto a molded three-dimensional plastic device, and activating a circuit pattern in a few seconds. For the design and production of the mobile phone antenna, Laser Direct Structuring refers to directly plating a metal antenna pattern on a structured plastic back shell by using laser technology. In the related art, there may be some seams in an antenna pattern structured by LDS and thus the antenna pattern has a defect of easily to be broken when dropped, and the laser plating and the electroless plating for the antenna pattern are difficult and time-consuming.

Therefore, it is necessary to provide an improved antenna module to solve the above problems.

BRIEF DESCRIPTION OF THE DRAWINGS

In order to illustrate the technical solutions in the embodiments of the present disclosure more clearly, the drawings used in the description of the embodiments will be briefly described below. It is obvious that the drawings in the following description relates to only some embodiments of the present disclosure. To those skilled in the art, other drawings can be obtained according to these drawings without any creative work, wherein.

DETAILED DESCRIPTION

Figure 1:
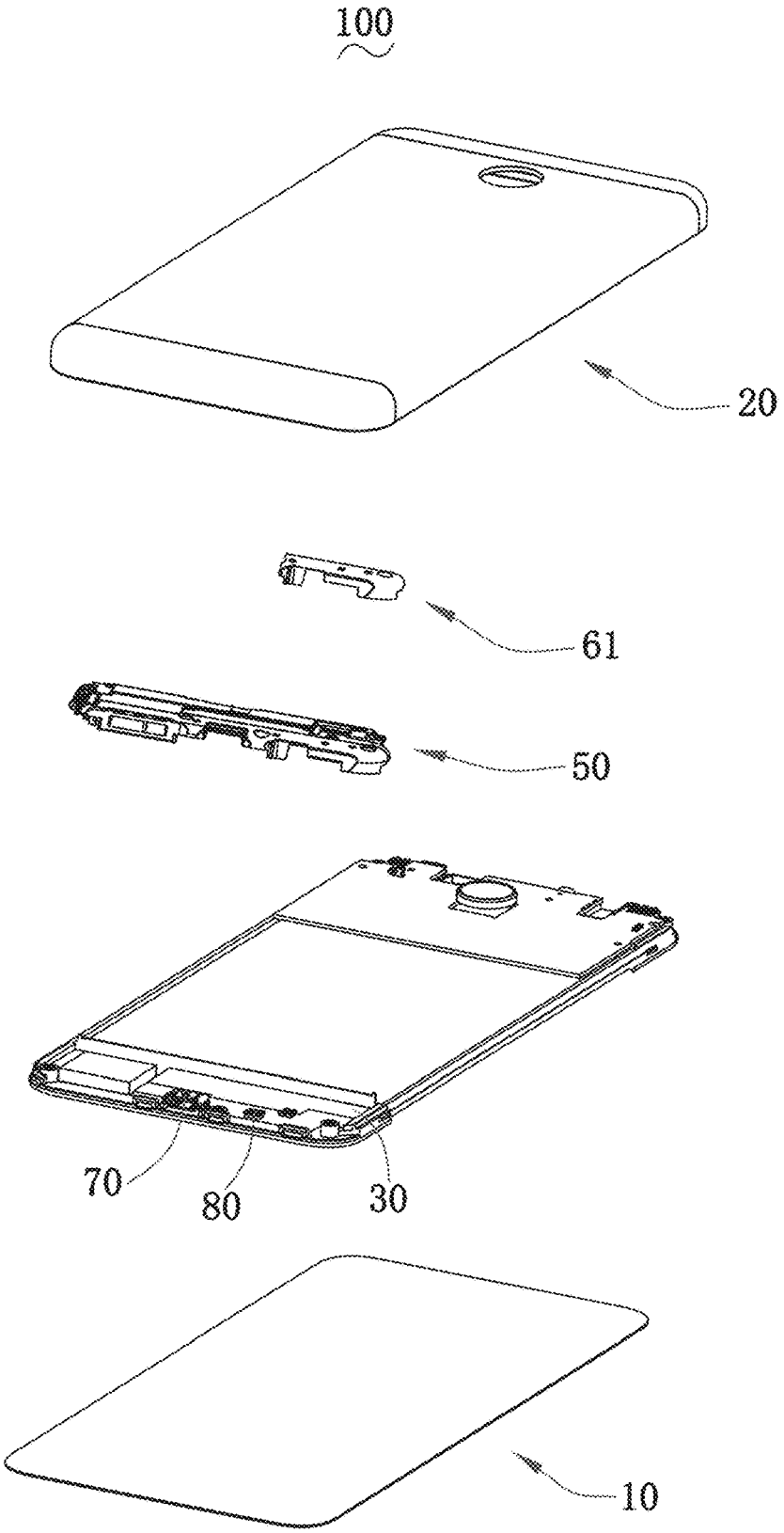
FIG. 1 is a perspective exploded structural view of a mobile terminal according to a preferred embodiment of the present disclosure.
Figure 2:
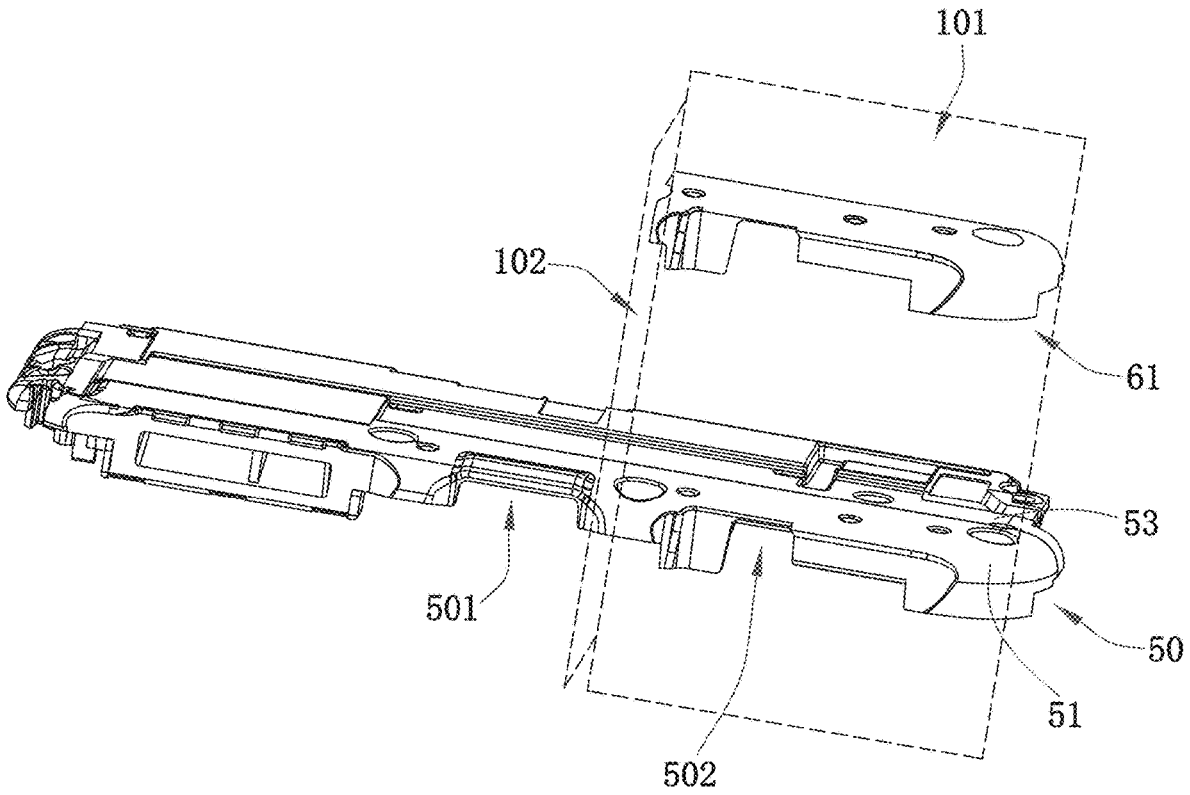
FIG. 2 is a perspective exploded view of a plastic back shell and a radiator of the mobile terminal shown in FIG. 1.
Figure 3:
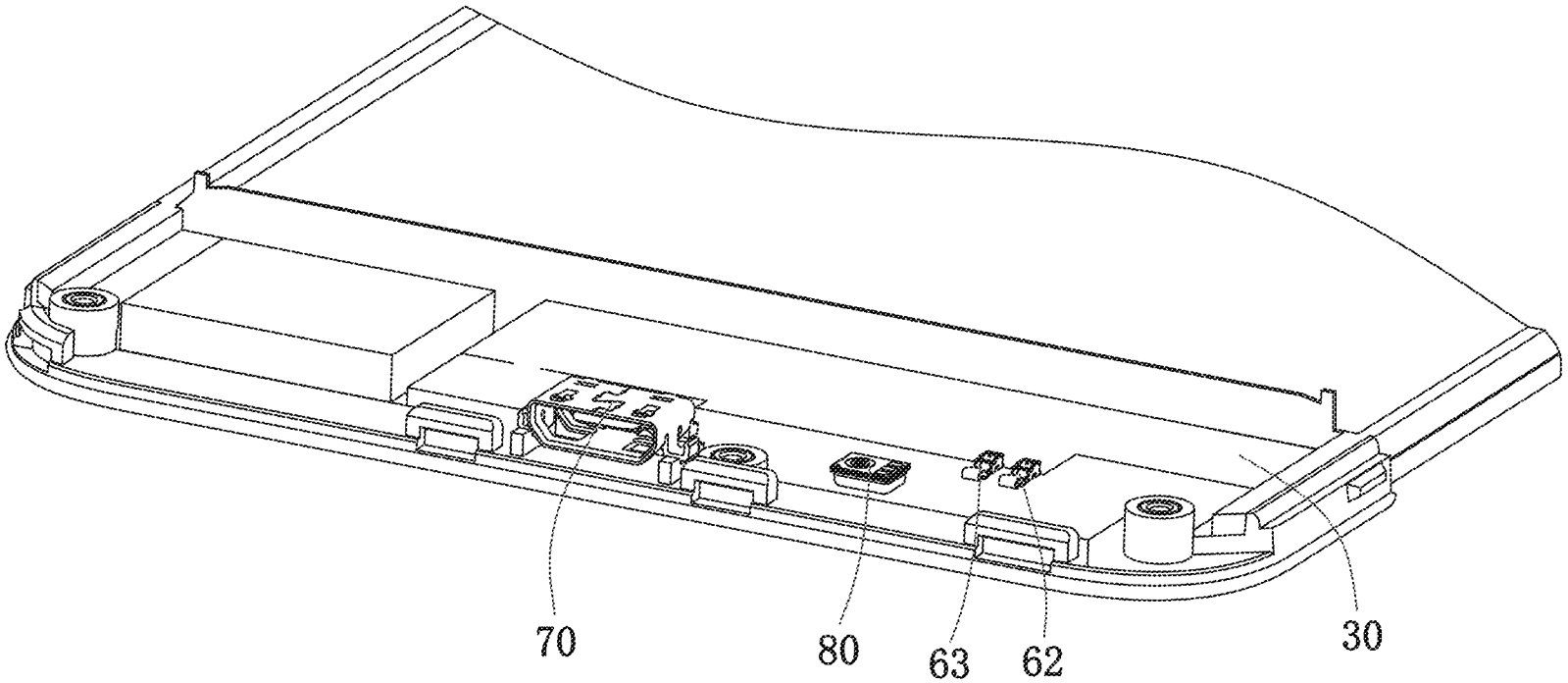
FIG. 3 is a partial perspective structural view of the mobile terminal shown in FIG. 1.

The technical solutions in the embodiments of the present disclosure will be clearly and completely described in conjunction with the drawings in the embodiments of the present disclosure. It is obvious that the described embodiments are just a part but not all of the embodiments of the present disclosure. All other embodiments obtained by those skilled in the art based on the embodiments of the present disclosure without creative efforts would fall within the scope of the present disclosure.

As shown in FIGS. 1 to 4, the embodiment of the present disclosure provides a mobile terminal 100, which may be a mobile phone, a tablet computer, a multimedia player, etc., for ease of understanding, the following embodiment is described by taking a smart phone as an example.

The mobile terminal 100 comprises a screen 10, a back cover 20 supporting the screen 10 and structuring an accommodating space together with the screen 10, a main board 30 received within the back cover 20, a plastic back cover 50 disposed between the back cover 20 and the main board 30 and enveloping the main board 30, an antenna module received in the accommodating space, and a USB interface 70 and a microphone 80 mounted on the main board 30. The antenna module is configured to implement the communication function of the mobile terminal. The USB interface 70 is configured to connect the mobile terminal with external devices and enable communication therebetween. The microphone 80 is configured to convert a sound signal into an electrical signal to implement call and record functions of the mobile terminal.

The plastic back shell 50 is disposed adjacent to a bottom of the mobile terminal 100, and the plastic back shell 50 is provided with a first through hole 501 communicating with a front end of the USB interface 70 and a second through hole 502 communicating with a front end of the microphone 80.

The antenna module comprises a radiator 61 structured on a surface of the plastic back shell 50 facing the back cover 20.

The surface of the plastic back shell 50 facing the back cover 20 comprises a first structuring region 51 for structuring the radiator 61 and a second region 53 which is a region of the surface other than the first structuring region 51. Specifically, there are only two boundary lines between the first structuring region 51 and the second region 52, one is located on a first plane 101 perpendicular to the main board 30 and parallel to the short axis of the mobile terminal 100, and the other is located on a second plane 102 perpendicular to both the first plane 101 and the main board 30.

For ease of understanding, the first structuring region 51 and the second region 53 are equivalent to two parts of the surface of the plastic back shell 50 facing the back cover 20 that are divided by the first plane 101 and the second plane 102. It should be noted that the first plane 101 and the second plane 102 are virtual planes that are defined for facilitating description of the shape of the radiator of the antenna module.

The radiator 61 is structured on the surface of the plastic back shell 50 facing the back cover and completely covers the first structuring region 51, and orthographic projections of the radiator 61 and the USB interface 70 on the main board 30 do not overlap with each other. The radiator 61 is structured in accordance with each of features on the first structuring region 51, and thus has the same contour with the first structuring region 51. Specifically, the radiator 61 is structured on the first structuring region 51 of the surface of the plastic back shell 50 through a LDS laser engraving process. Since the radiator 61 completely covers the first structuring region 51 and has a simple outer contour, it is not necessary to design a complicated laser engraving line when performing LDS laser engraving, which simplifies the laser engraving process and reduces the requirements on precision of the laser engraving process.

In the present embodiment, the mobile terminal 100 has a rectangular structure, and the first structuring region 51 is located at the lower right corner of the mobile terminal 100 and on the right side of the USB, that is, the radiator 61 is disposed at the lower right corner of the mobile terminal 100. On the one hand, the layout is more space-saving than the conventional scheme and is more suitable for a MIMO terminal with an increased number of antennas. On the other hand, the radiator 61 is not disposed across the USB interface 70; therefore, the influence of USB interfaces 70 on the antenna is reduced. Moreover, it is convenient to adjust the installation position of the radiator 61 or the USB interface 70 with a larger operable space.

In addition, it should be noted that, in this embodiment, the antenna module is an antenna of ⅛ wavelength, that is, the length of the radiator is about ⅛ of the lowest working frequency band, which further reduces the space occupied by the radiator and facilitating increment of the number of antennas in a limited space.

The antenna module further comprises a feeding point 62, a grounding point 63, a matching network 64, a first tuning switch 65, a second tuning switch 66, and a third tuning switch 67 disposed on the main board 30. The feeding point 62 is connected to the radiator 61 through the matching network 64. The grounding point 63 is connected to the radiator 61 through the first tuning switch 65, one end of the second tuning switch 66 is connected to the matching network 64 and the other end is grounded; one end of the third tuning switch 67 is connected to the matching network 64 and the other end is grounded.

In the present embodiment, the feeding point 62 and the grounding point 63 are located at a side of the microphone 80 away from the USB interface 70.

Figure 4:
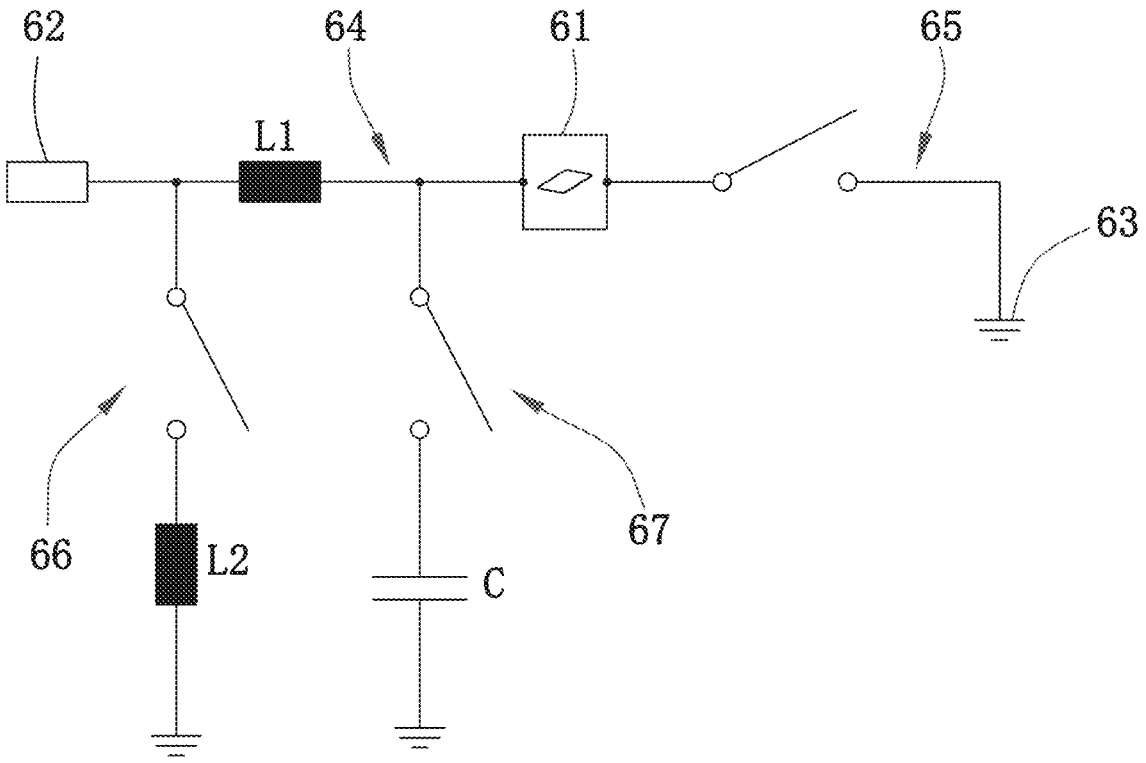
FIG. 4 is a view illustrating a circuit connection structure of a specific embodiment for an antenna module of the mobile terminal shown in FIG. 1.

Referring to FIG. 4, the matching network 64 comprises a first inductor L1, a first end of the first inductor L1 is connected to the feeding point 62 and the second tuning switch 66 respectively, and a second end thereof is connected to the radiator 61 and the third tuning switch 67 respectively. One end of the first tuning switch 65 is connected to the radiator 61 and the other end thereof is grounded. The second tuning switch 66 comprises a second inductor L2, and one end of the second inductor L2 is connected to the first end of the first inductor L1 and the other end thereof is grounded. The third tuning switch 67 comprises a capacitor C, and one end of the capacitor C is connected to the second end of the first inductor L1 and the other end is grounded. In this embodiment, the first inductor L1 has an inductance of 3 nH, the second inductor L2 has an inductance of 2.5 nH, and the capacitor C has a capacitance of 1.7 pF.

Each of the first tuning switch 65, the second tuning switch 66, and the third tuning switch 67 has an Switched-off state and an Switched-on state. If the second tuning switch 66 and the third tuning switch 67 are in an Switched-on state and the first tuning switch 65 is in an Switched-off state, the radiator 61 covers an operating frequency band of 790~862 MHz; if the second tuning switch 66 is in an Switched-on state and the first tuning switch 65 and the third tuning switch 67 are in an Switched-off state, the radiator 61 covers an operating frequency band of 862~960 MHz; and if the first tuning switch 65 and the third tuning switch 67 are in an Switched-on state and the second tuning switch 66 is in an Switched-off state, the radiator 61 covers an operating frequency band of 1710-2690 MHz. In the present embodiment, the operating frequency bands covered by the radiator 61 include 790-960 MHz and 1710-2690 MHz.

Figure 5:
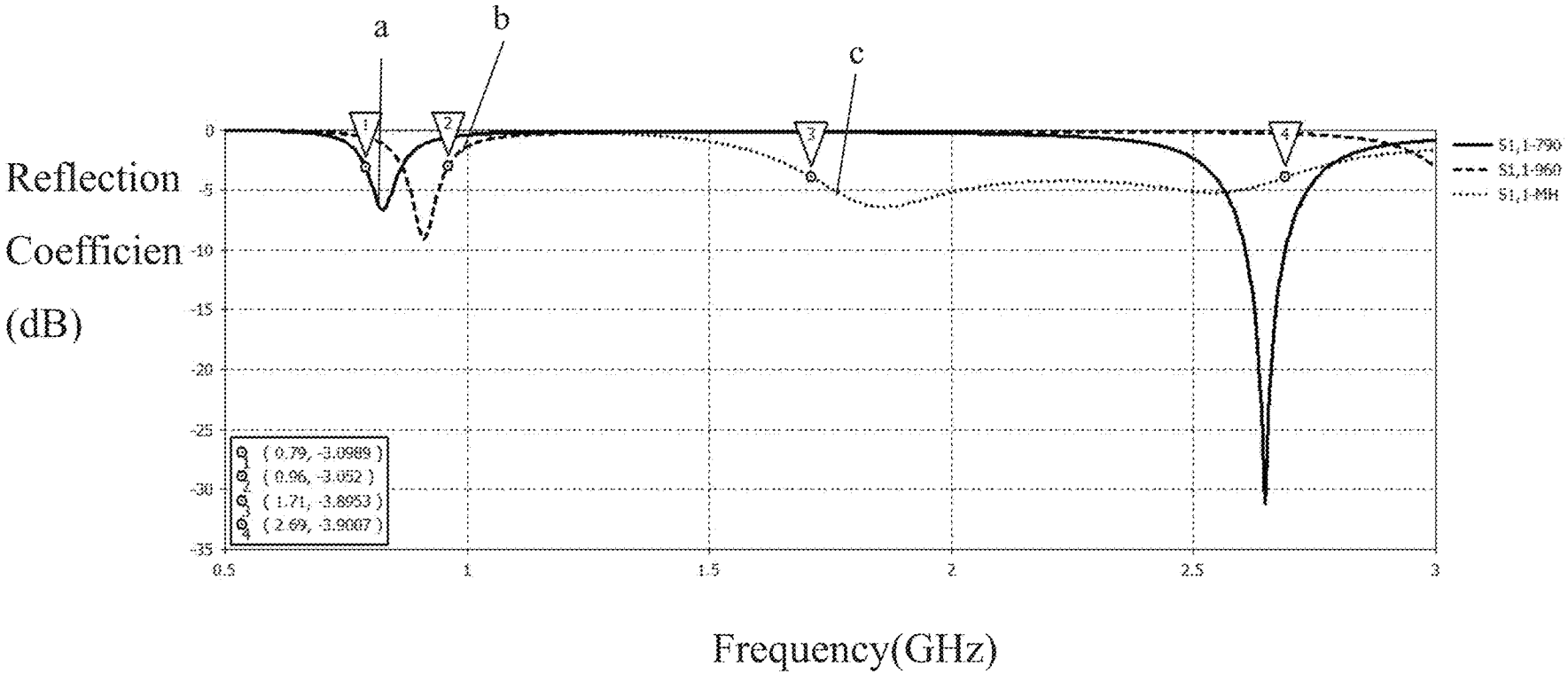
FIG. 5 is a graph illustrating a simulation effect of a reflection coefficient of the antenna module of the mobile terminal provided by the present disclosure.
Figure 6:
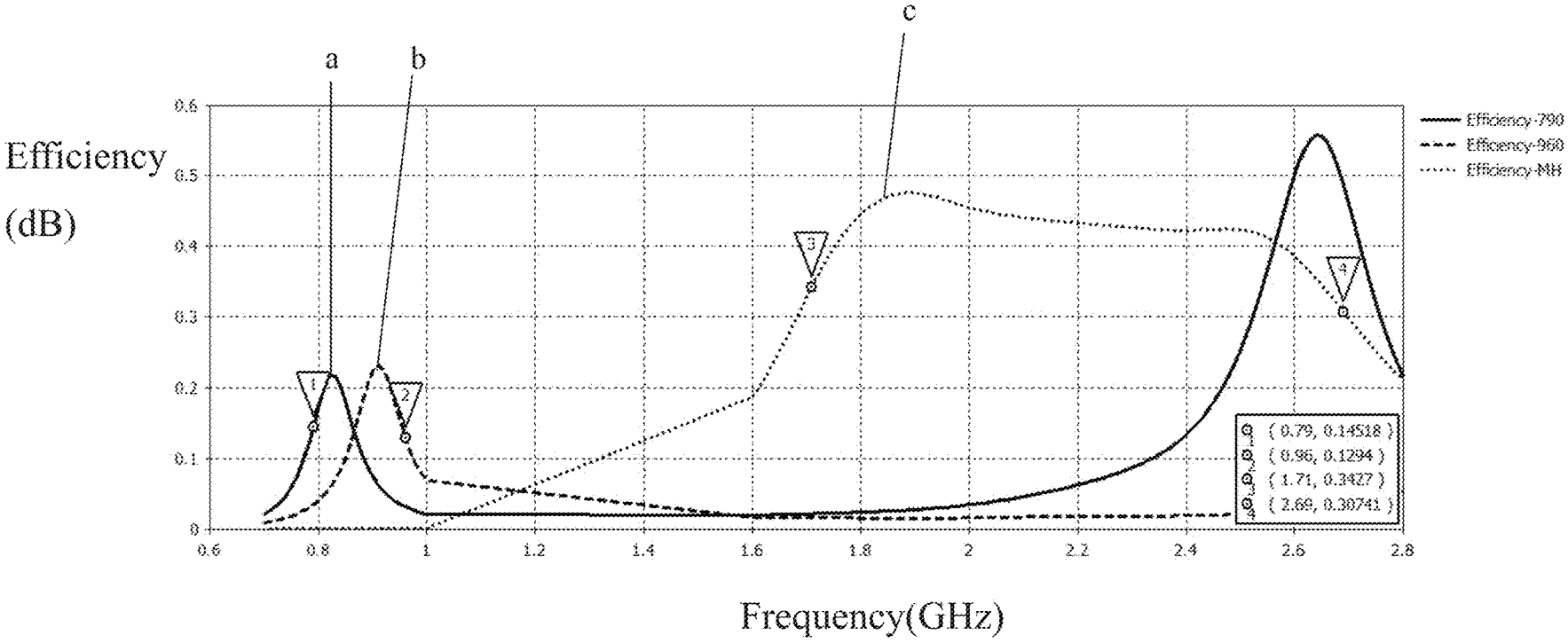
FIG. 6 is a graph illustrating a simulation effect of the efficiency of the antenna module of the mobile terminal provided by the present disclosure.

Based on the above structure, if the first tuning switch 65, the second tuning switch 66, and the third tuning switch 67 in the antenna module of the present disclosure are in an Switched-off state and an Switched-on state, the reflection coefficient and efficiency of each operating frequency band are shown in FIG. 5 and FIG. 6, where the abscissas in FIG. 5 and FIG. 6 represent frequencies in GHz, and the ordinates in FIG. 5 and FIG. 6 represent reflection coefficient and efficiency respectively, each in dB. The curve "a" indicates that the second tuning switch 66 and the third tuning switch 67 are in an Switched-on state and the first tuning switch 65 is in an Switched-off state, the curve "b" indicates that the second tuning switch 66 is in an Switched-on state and the first tuning switch 65 and the third tuning switch 67 are in an Switched-off state, and the curve "c" indicates that the first tuning switch 65 and the third tuning switch 67 are in an Switched-on state and the second tuning switch 66 is in an Switched-off state.

Compared with the related art, the antenna module and the mobile terminal provided by the present disclosure have the following beneficial effects: the radiator of the antenna module is entirely laid on the surface of the plastic back shell facing the back cover and thus has a large area, which overcomes the defect that the existing LDS traces are easy to be broken and significantly improves the anti-drop ability; the structure is simple, and when structured by LDS, the time and difficulty of laser plating and electroless plating can be reduced, so it is easier to be structured; compared with the conventional scheme, it is more space-saving and more suitable for MIMO terminal with an increased number of antennas; the radiator does not disposed across the USB interface, therefore, the influence of the USB interface on the antenna is reduced, and moreover, it is convenient to adjust the positions of the radiator and the USB interface, thus proving a flexible operability.

The above only describes the embodiments of the present disclosure, and it should be noted that those skilled in the art could make improvements without departing from the concept of the present disclosure, and all of these improvements fall within the protection scope of the present disclosure.

What is claimed is:

1. An antenna module applied to a mobile terminal, wherein, the mobile terminal comprises a back cover, a main board received within the back cover, a plastic back shell located between the back cover and the main board and enveloping the main board, and a USB interface mounted on the main board, the plastic back shell is disposed adjacent to a bottom of the mobile terminal, and the antenna module comprises a radiator structured on a surface of the plastic back shell facing the back cover and a feeding point and a grounding point disposed on the main board, wherein, the antenna module further comprises a matching network, a first tuning switch, a second tuning switch and a third tuning switch, the feeding point is connected to the radiator through the matching network, the grounding point is connected to the radiator through the first tuning switch, one end of the second tuning switch is connected to the matching network and the other end is grounded, one end of the third tuning switch is connected to the matching network and the other end is grounded; and the surface of the plastic back shell facing the back cover includes a first structuring region for structuring the radiator and a second region which is a region of the surface other than the first structuring region, the radiator completely covers the first structuring region, and orthographic projections of the radiator and the USB interface on the main board do not overlap with each other; there are only two boundary lines between the first structuring region and the second region, one of them is located on a first plane perpendicular to the main board and parallel to a short axis of the mobile terminal, the other is located on a second plane perpendicular to both the first plane and the main board, and a length of the radiator is ⅛ of a wave length at the lowest working frequency of the antenna module.

2. The antenna module according to claim 1, wherein the mobile terminal has a rectangular structure, and the first structuring region is located at a lower right corner of the mobile terminal.

3. The antenna module according to claim 1, wherein the radiator is laser-plated on the surface of the plastic back shell facing the back cover through a LDS process.

4. The antenna module according to claim 1, wherein the first tuning switch, the second tuning switch, and the third tuning switch each have a Switched-off state and a Switched-on state;

if the second tuning switch and the third tuning switch are in a Switched-on state and the first tuning switch is in a Switched-off state, the radiator covers an operating frequency band of 790~862 MHz;

if the second tuning switch is in an Switched-on state and the first tuning switch and the third tuning switch are in an Switched-off state, the radiator covers an operating frequency band of 862~960 MHz;

if the first tuning switch and the third tuning switch are in an Switched-on state and the second tuning switch is in an Switched-off state, the radiator covers an operating frequency band of 1710-2690 MHz.

5. A mobile terminal comprising an antenna module, wherein, the mobile terminal comprises a back cover, a main board received within the back cover, a plastic back shell located between the back cover and the main board and enveloping the main board, and a USB interface mounted on the main board, the plastic back shell is disposed adjacent to a bottom of the mobile terminal, and the antenna module comprises a radiator structured on a surface of the plastic back shell facing the back cover and a feeding point and a grounding point disposed on the main board, wherein, the antenna module further comprises a matching network, a first tuning switch, a second tuning switch and a third tuning switch, the feeding point is connected to the radiator through the matching network, the grounding point is connected to the radiator through the first tuning switch, one end of the second tuning switch is connected to the matching network and the other end is grounded, one end of the third tuning switch is connected to the matching network and the other end is grounded; and the surface of the plastic back shell facing the back cover includes a first structuring region for structuring the radiator and a second region which is a region of the surface other than the first structuring region, the radiator completely covers the first structuring region, and orthographic projections of the radiator and the USB interface on the main board do not overlap with each other; there are only two boundary lines between the first structuring region and the second region, one of them is located on a first plane perpendicular to the main board and parallel to a short axis of the mobile terminal, the other is located on a second plane perpendicular to both the first plane and the main board, and a length of the radiator is ⅛ of a wave length at the lowest working frequency of the antenna module.

6. The mobile terminal according to claim 5, wherein the mobile terminal has a rectangular structure, and the first structuring region is located at a lower right corner of the mobile terminal.

7. The mobile terminal according to claim 5, wherein the radiator is laser-plated on the surface of the plastic back shell facing the back cover through a LDS process.

8. The mobile terminal according to claim 5, wherein the first tuning switch, the second tuning switch, and the third tuning switch each have a Switched-off state and a Switched-on state;

if the second tuning switch and the third tuning switch are in a Switched-on state and the first tuning switch is in a Switched-off state, the radiator covers an operating frequency band of 790~862 MHz;

if the second tuning switch is in an Switched-on state and the first tuning switch and the third tuning switch are in an Switched-off state, the radiator covers an operating frequency band of 862~960 MHz;

if the first tuning switch and the third tuning switch are in an Switched-on state and the second tuning switch is in an Switched-off state, the radiator covers an operating frequency band of 1710-2690 MHz.

9. The mobile terminal according to claim 5, further comprising a microphone mounted on the main board and under the radiator, wherein, the feeding point and the grounding point are located at a side of the microphone away from the USB interface.

* * * * *